US009850090B2

(12) United States Patent
Pilar

(10) Patent No.: US 9,850,090 B2
(45) Date of Patent: Dec. 26, 2017

(54) DRUM INTERMEDIATE STORAGE DEVICE FOR A TEXTILE MACHINE

(71) Applicant: Rieter CZ s.r.o., Usti nad Orlici (CZ)

(72) Inventor: Evzen Pilar, Litomysl (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 288 days.

(21) Appl. No.: 14/575,215

(22) Filed: Dec. 18, 2014

(65) Prior Publication Data

US 2015/0175381 A1 Jun. 25, 2015

(30) Foreign Application Priority Data

Dec. 20, 2013 (CZ) ..... 2013-1061

(51) Int. Cl.

| | |
|---|---|
| ***B65H 51/22*** | (2006.01) |
| ***D01H 13/10*** | (2006.01) |
| ***B65H 59/18*** | (2006.01) |
| ***D04B 15/48*** | (2006.01) |

(52) U.S. Cl.

CPC ..... *B65H 51/22* (2013.01); *B65H 59/18* (2013.01); *D01H 13/104* (2013.01); *D01H 13/108* (2013.01); *D04B 15/482* (2013.01); *B65H 2701/31* (2013.01)

(58) Field of Classification Search

CPC ..... B65H 51/22; B65H 59/18; D04B 15/482; D01H 13/104; D01H 13/108

See application file for complete search history.

(56) References Cited

U.S. PATENT DOCUMENTS

| | | | | |
|---|---|---|---|---|
| 4,114,822 A | | 9/1978 | Jacobsson | |
| 4,553,709 A | * | 11/1985 | Bock | B65H 51/22 242/364.8 |
| 5,647,195 A | * | 7/1997 | Josoff | H01B 13/025 242/364 |
| 2014/0034770 A1 | | 2/2014 | Sloupensky et al. | |

FOREIGN PATENT DOCUMENTS

| | | | | |
|---|---|---|---|---|
| JP | EP 1457446 A2 | * | 9/2004 | B65H 51/22 |
| JP | EP 2075359 A2 | * | 7/2009 | B65H 51/22 |
| JP | EP 2189557 A1 | * | 5/2010 | B65H 51/22 |

OTHER PUBLICATIONS

EP Search Report, dated May 13, 2015.

* cited by examiner

*Primary Examiner* — William E Dondero
(74) *Attorney, Agent, or Firm* — Dority & Manning, P.A.

(57) ABSTRACT

The invention relates to a drum intermediate storage of yarn for a textile machine having a driven rotary drum with a working surface and a movable radial rotary arm. The driven rotary drum is coupled with a first drive and the arm is coupled with a second drive, whereby both drives are composed of motors and both motors are connected to a control system of the textile machine. The radial rotary arm is provided with a yarn guide, whose working portion upholds the yarn radially relative to the axis of rotation of the drum.

7 Claims, 3 Drawing Sheets

DRUM INTERMEDIATE STORAGE DEVICE FOR A TEXTILE MACHINE

TECHNICAL FIELD

The invention relates to a drum intermediate storage of yarn of a textile machine, which comprises a driven rotary drum with a working surface and a movable compensatory rotary arm in which the driven rotary drum is coupled with a first drive and the compensatory rotary arm is coupled with a second drive, both drives are composed as motors and are connected to a control system of the textile machine.

BACKGROUND ART

In the devices for drawing-off and winding yarn in an open-end spinning machine, it is difficult to meet all the technological requirements for the formation of a cross wound cylindrical, particularly conical bobbin, and to make sure that the construction of the machine is simple from the point of view of spinning-in yarn. In an open-end spinning machine, yarn is produced in the rotor of the spinning unit and is drawn-off by a pair of draw-off rollers, in which the yarn is led onto a bobbin leaning on a winding roller with the distribution of yarn. However, during the cross winding of the yarn on the bobbin, different lengths of the yarn travel path arise when the yarn is being distributed from one extreme position to another, and, as a result, the yarn is wound under unequal tensions.

CZ 303880 discloses a drum intermediate storage of yarn for a textile machine which comprises a driven rotary drum with a compensatory rotary arm, where the driven rotary drum is coupled with a first drive composed of an electric motor and the compensatory arm is coupled with a second drive composed of an electric motor, whereby both motors are connected to a control system of the spinning machine. The outlet portion of the driven rotary drum is provided at its end, i.e. by the compensatory rotary arm, with an extension that restricts or prevents undesired yarn slipping from the working surface of the driven rotary drum outside the movable compensatory arm. The movable compensatory arm is provided at its free end with a yarn guide which runs around the outer circumference of the outlet portion of the drum and acts on the yarn in a defined manner.

However, there is a disadvantage that limits the applicability of this drum intermediate storage of yarn—namely the presence of the extended portion of the drum near the movable compensatory rotary arm, which means that it is necessary to construct the yarn guide on the movable rotary arm substantially in the shape of a bent elongated body of a circular cross section, such as a wire.

The goal of the invention is to eliminate or at least minimize the disadvantages of the background art, and, above all, to improve the applicability of the drum intermediate storage of yarn.

SUMMARY OF THE INVENTION

Additional objects and advantages of the invention will be set forth in part in the following description, or may be obvious from the description, or may be learned through practice of the invention.

The aim of the invention is achieved by a drum intermediate storage of yarn, whose principle consists in that the radial rotary arm is provided with a yarn guide, whose working portion upholds the yarn radially in relation to the axis of the drum rotation.

The advantage of this embodiment is the fact that it enables to improve the exploitation of the drum intermediate storage of yarn for individual processes at an operating unit of a textile machine while preserving the advantages of the drum intermediate storage of yarn and its high efficiency.

DESCRIPTION OF DRAWINGS

The invention is schematically shown in the drawings, where.

SPECIFIC DESCRIPTION

Figure 1:
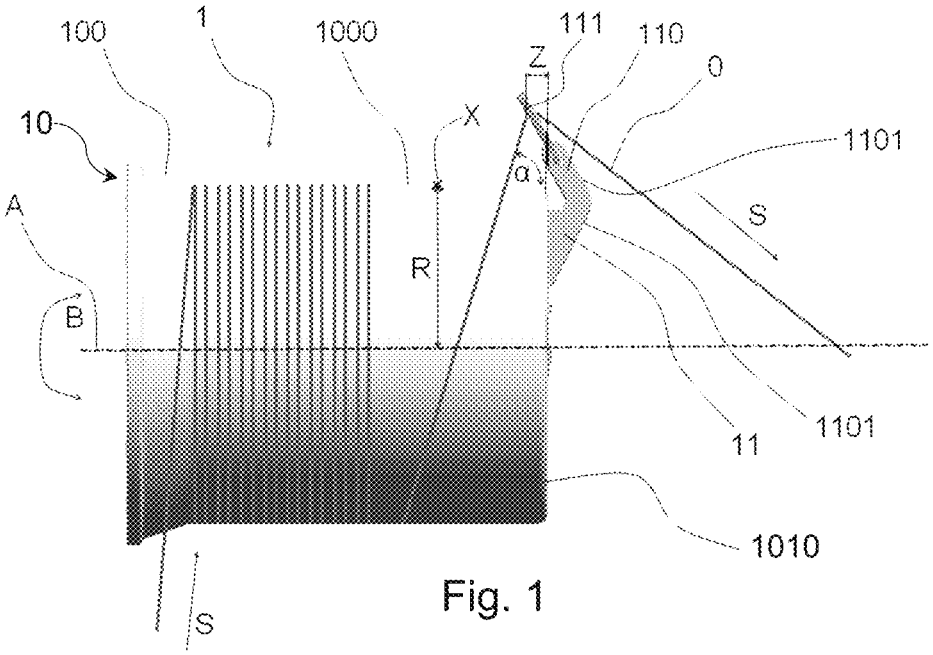
FIG. 1 shows a side view of an arrangement of a drum intermediate storage of yarn with a radial rotary arm.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The drum intermediate storage of yarn is situated at an operating unit of a textile machine. Ideally, the textile machine comprises a row of identical operating units, arranged next to each other. At the operating unit are arranged individual devices for yarn formation from staple fibers, for example from staple fibers arranged in the form of a sliver or fiber band etc., and for subsequent winding the produced yarn on a bobbin.

Between the device for forming yarn and the device for winding yarn onto a bobbin is arranged a draw-off mechanism, which serves to draw-off the produced yarn from the yarn forming device.

The drum intermediate storage 1 of yarn is arranged between the draw-off mechanism and the device for winding yarn onto a bobbin. In the yarn path between the draw-off mechanism and the front portion 100 of the drum intermediate storage 1 of yarn 0 is arranged an unillustrated input guiding means of yarn 0 from the draw-off mechanism to the working surface 1000 of the drum 10 of the drum intermediate storage 1 of yarn 0. In the yarn path between the end edge 1010 of the drum intermediate storage 1 of yarn 0 and the yarn winding device is arranged an output guiding means of yarn 0. The yarn 0 during routine operation, i.e. when being formed and wound onto a bobbin, moves in a direction S, whereby also the drum 10 moves in this mode and rotates in the same direction, as will be explained further on. The working surface 1000 of the drum 10 is designed as a continuous rotary surface or it is made up of a group of segments forming a substantially continuous rotary surface or it is made as an enveloping area of a wire body etc. Therefore, in essence, it is not important which particular type of construction of the drum 10 is used.

The drum intermediate storage 1 of yarn 0 comprises a rotatably mounted drum 10, which is coupled with a drive connected to an energy source and to a control device.

In an illustrated example of embodiment, the working surface 1000 of the drum 10 is in the front portion 100 of the drum 10 formed by a conical surface which is sloping downwards from the front portion of the drum 10 towards the rear portion of the drum 10. Behind the conical front portion 100, the working surface 1000 of the drum 10 continues as the main area 101, which is also conical, sloping downwards from the front portion of the drum 10 towards the rear portion of the drum 10, preferably with the size of the slope ranging from 0.5 to 5°, yet more preferably from 1 to 2° in relation to the rotation axis A of the drum 10. In another embodiment, the drum 10 has a different suitable profile, for example a profile shaped as a continuous curve or it could have a profile of any other suitable shape with a gradually diminishing distance R of the generatrix X from the axis A of rotation of the drum 10, conceived in the direction from the front portion to the rear portion of the drum 10. In another unillustrated embodiment, the drum 10 has a cylindrical shape or there is an extension at the end of the drum 10.

The end edge 1010 of the main area 101 of the working surface 1000 at the end of the drum 10 is rounded or chamfered.

A radial rotary arm 11 is mounted on an independently rotatable shaft (not shown), whose axis of rotation is in the illustrated embodiment identical to the axis A of rotation of the drum 10. The radial rotary arm 11 is coupled with a separate drive which is independent of the drive of the drum 10. The independent drive of the arm 11 is connected to a source of energy and to a control device, as is the case of the drive of the drum 10. In an unillustrated embodiment, the rotation axis of the radial rotary arm 11 is different from the axis A of rotation of the drum 10.

The arm 11 is at its free end 110 provided with a rigid or replaceable guide 111 of yarn 0, which radially upholds the yarn 0 above the perpendicular projection onto the main area 101 of the drum 10. The working surface 1110 of the guide 111 of yarn 0, i.e. that part against which the yarn 0 rubs when passing from the main area 101 of the working surface 1000 of the drum 10 to the outlet guide of yarn 0, is situated in the direction of the motion of yarn 0 before the end edge 1010 of the working surface 1000 of the drum 10, i.e. as is shown in the drawing, it is situated above the main area 101 of the working surface 1000 of the drum 10.

Figure 2:
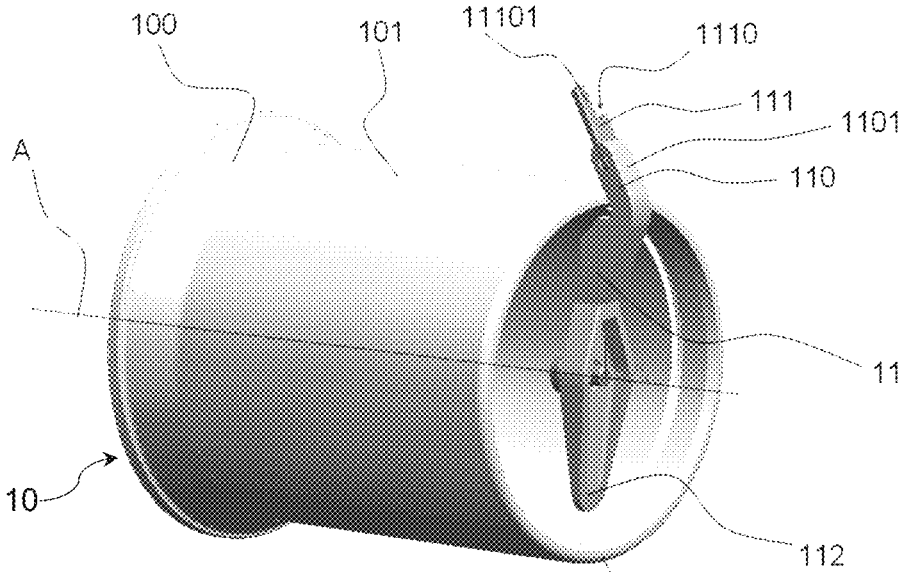
FIG. 2 provides a skew view of an arrangement of a drum intermediate storage of yarn with a radial rotary arm.
Figure 3:
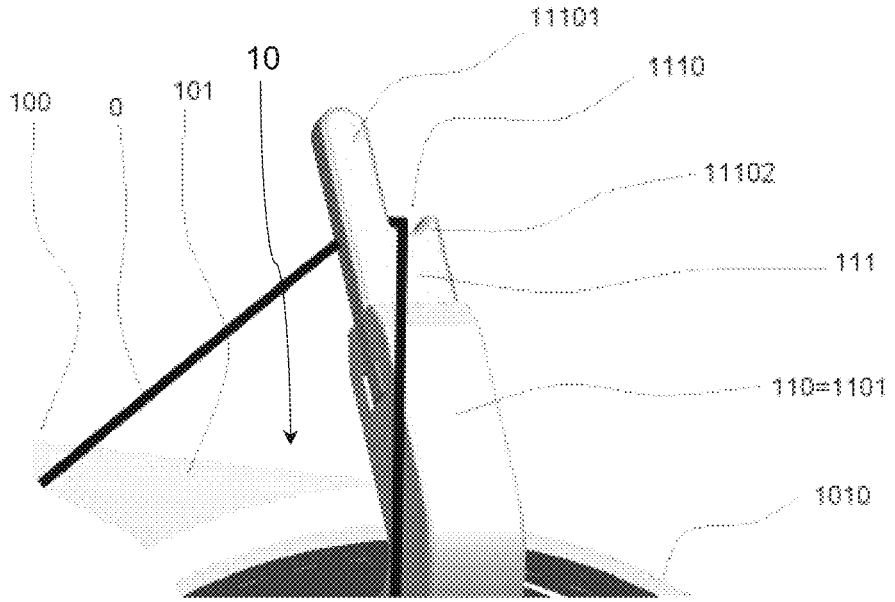
FIG. 3 shows a detail of an arrangement of the working portion of a yarn guide of the radial rotary arm and the drum.

As is shown in FIGS. 1 to 3, the radial rotary arm 11 comprises a bent portion with a free end 110 and a guide 111 of yarn 0, whose working portion 1110 (of the guide 111 of yarn 0) is situated above the main area 101 of the working surface 1000 of the drum 10. This arrangement enables to prevent effectively unwanted slipping of yarn 0 from the main area 101 of the working surface 1000 of the drum 10, since, in the illustrated embodiment, the yarn 0 is from the main area 101 of the working surface 1000 removed by the guide 111 under an acute angle $\alpha$ in the distance Z before the end edge 1010 of the main area 101 of the working surface 1000 of the drum 10. Another advantage of this arrangement is that in the case of the unwinding of yarn 0 from the bobbin to the drum intermediate storage 1 of yarn 0 the yarn 0 is guided and wound reliably on the working surface 1000 of the drum 10.

In the embodiment shown in FIG. 3, the working portion 1110 of the guide 111 of yarn 0 is made as a groove in the body of the guide 111, whereby in the direction B of rotation of the drum 10 when winding yarn on the bobbin, i.e. in the mode of forming yarn 0, on the rear part of the working portion 1110 is arranged a retention projection 11101, which exceeds the inlet projection 11102 of the groove arranged on the front part of the working portion 1110. In an unillustrated embodiment, the working surface 1110 of the guide 111 of yarn 0 is created in another suitable method which ensures reliable and safe capturing of the yarn 0 by the guide 111 and subsequent reliable and safe guidance of the yarn 0 over the working surface 1110 of the drum 10 to the outlet guiding means of yarn 0 in all modes of the motion of the arm 11 in relation to the drum 10, including the case, when the arm 11 moves against the direction of the rotation of the drum 10, thus ensuring reliable and safe radial support of yarn 0 above the main area 101 of the drum 10.

In an illustrated embodiment, the guide 111 of yarn 0 is designed as a replaceable unit displaceably mounted on the arm 11, so that in case of need it is only this small unit that has to be replaced and this operation can be performed readily and quickly. In an illustrated embodiment, the guide 111 of yarn 0 is designed as part of the arm 11, which is easily and readily removable from the construction of the device and, consequently, is easily and readily replaceable.

So as to improve the durability of the device and reduce the abrasion of the produced yarn 0, at least the working portion 1110 of the guide 111 of yarn 0 is equipped with wear-resistant means, especially resistant to wear caused by the abrasion of the yarn 0, by which means that at least this portion of the guide 111 of yarn 0 is more wear-resistant than the material of the arm 11. These wear-resistant means consist of, for example, a protective coating and/or a rolling means and/or another suitable means.

In an unillustrated embodiment, the guide 111 is constructed as an integral part of the arm 11 and when it is necessary the whole arm 11 including the guide, is replaced. In this case the guide 111 can be also made of material other than the basic material of the arm 11 or the guide is made of the basic material used to make the arm 11, optionally provided with a protective coating.

Figure 4:
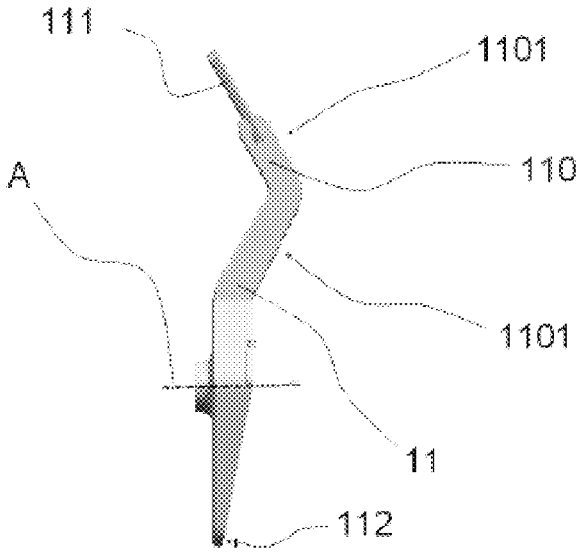
FIG. 4 represents an arrangement of a radial rotary arm.

In the example of embodiment in FIG. 4, there is a view of an embodiment of a drum 1 with a radial rotary arm 11 and a guide 111 of yarn, whereby the arm 11 has an optimized shape in order not to impede the removal of the yarn from the intermediate storage, or, to be precise, from the drum 1. For these purposes, the arm 11 in the illustrated example of embodiment has skew surfaces 1101 for yarn slipping, whereby the arm 11 is, during the removal of the yarn, located between the guide 111 in the direction in which the yarn is removed. The opposite end 112 of the arm 11 is situated substantially in the inner space of the drum 1, i.e. it is hidden beyond the end edge 1010 of the drum 1, and so it does not hinder free motion of the yarn during the removal of the yarn.

Modifications and variations can be made to the embodiments illustrated or described herein without departing from the scope and spirit of the invention as set forth in the appended claims.

The invention claimed is:

1. A drum intermediate yarn storage device for a textile machine, comprising:

a driven rotary drum having a front portion and a rear portion defined by an end edge, the driven rotary drum further comprising a working surface defined between the front and rear portion on which yarn is wound;

a driven radial rotary arm disposed at the end edge of the rotary drum;

the radial rotary arm further comprising a yarn guide at a free end thereof, the yarn guide comprising a working portion, the working portion disposed at a position so as to uphold the yarn and contact the yarn radially above and over the working surface at a defined distance from the end towards the front portion relative to a rotational axis of the rotary drum.

2. The drum intermediate yarn storage device of claim 1, wherein the rotary drum has a main area that defines the working surface, the main area having a gradually diminishing circumferential cross-sectional profile relative to the rotational axis of the rotary drum.

3. The drum intermediate yarn storage device of claim 1, wherein the working portion of the yarn guide comprises a radially extending retention projection.

4. The drum intermediate yarn storage device of claim 1, wherein the yarn guide is removable and replaceable relative to the rotary arm.

5. The drum intermediate yarn storage device of claim 1, wherein the yarn guide comprises a wear resistant surface that resists abrasion from the yarn moving over the yarn guide.

6. The drum intermediate yarn storage device of claim 5, wherein the wear resistant surface comprises a material coating on the yarn guide or a surface of the yarn guide configured to enhance rolling of the yarn over the yarn guide.

7. The drum intermediate yarn storage device of claim 1, wherein the rotary drum has a conical main area that defines the working surface, the conical main area sloping from the front portion towards the rear portion at a slope of between 0.5 to 5.0 degrees.

* * * * *